US005129249A

United States Patent [19]

Fournier

[11] Patent Number: 5,129,249

[45] Date of Patent: Jul. 14, 1992

[54] PROCESS AND APPARATUS FOR FORMING A CIRCULAR LIP AROUND AN OPENING

[75] Inventor: Yves Fournier, Chatenoy le Royal, France

[73] Assignee: Framatome, Courbevoie, France

[21] Appl. No.: 665,080

[22] Filed: Mar. 6, 1991

[30] Foreign Application Priority Data

Mar. 6, 1990 [FR] France ..... 90 02817

[51] Int. Cl.[5] ..... B21D 19/04

[52] U.S. Cl. ..... 72/70; 72/117; 72/123

[58] Field of Search ..... 72/70, 115, 117, 120, 72/123, 125, 126, 124

[56] References Cited

U.S. PATENT DOCUMENTS

| | | | |
|---|---|---|---|
| 18,452 | 10/1857 | Howell | 72/117 |
| 157,810 | 12/1874 | Garstang | 72/117 |
| 743,644 | 11/1903 | Johnson | 72/117 |
| 1,011,000 | 12/1911 | Worth et al. | 72/115 |
| 1,753,963 | 4/1930 | Mauser | 72/110 |
| 3,151,657 | 10/1964 | Beranek . | |
| 4,246,772 | 1/1981 | Moshnin et al. . | |

FOREIGN PATENT DOCUMENTS

| | | |
|---|---|---|
| 0002163 | 5/1979 | European Pat. Off. . |
| 2814176 | 10/1978 | Fed. Rep. of Germany . |
| 1198440 | 12/1959 | France . |
| 1572835 | 6/1969 | France . |
| 2337600 | 8/1977 | France . |

OTHER PUBLICATIONS

SU 1479158 Al Kova-67-87, May, 1989.

*Primary Examiner*—Lowell A. Larson
*Attorney, Agent, or Firm*—Pollock, Vande Sande & Priddy

[57] ABSTRACT

After machining, the floor of a countersink is chased by means of rollers driven to execute an orbital motion, the angle which the attack surface of the rollers forms with the axis of the opening being progressively reduced as a function of the advance of the roller carrier. Application to the forming of connecting lips around the openings of a nuclear reactor vessel barrel.

11 Claims, 3 Drawing Sheets

FIG.4
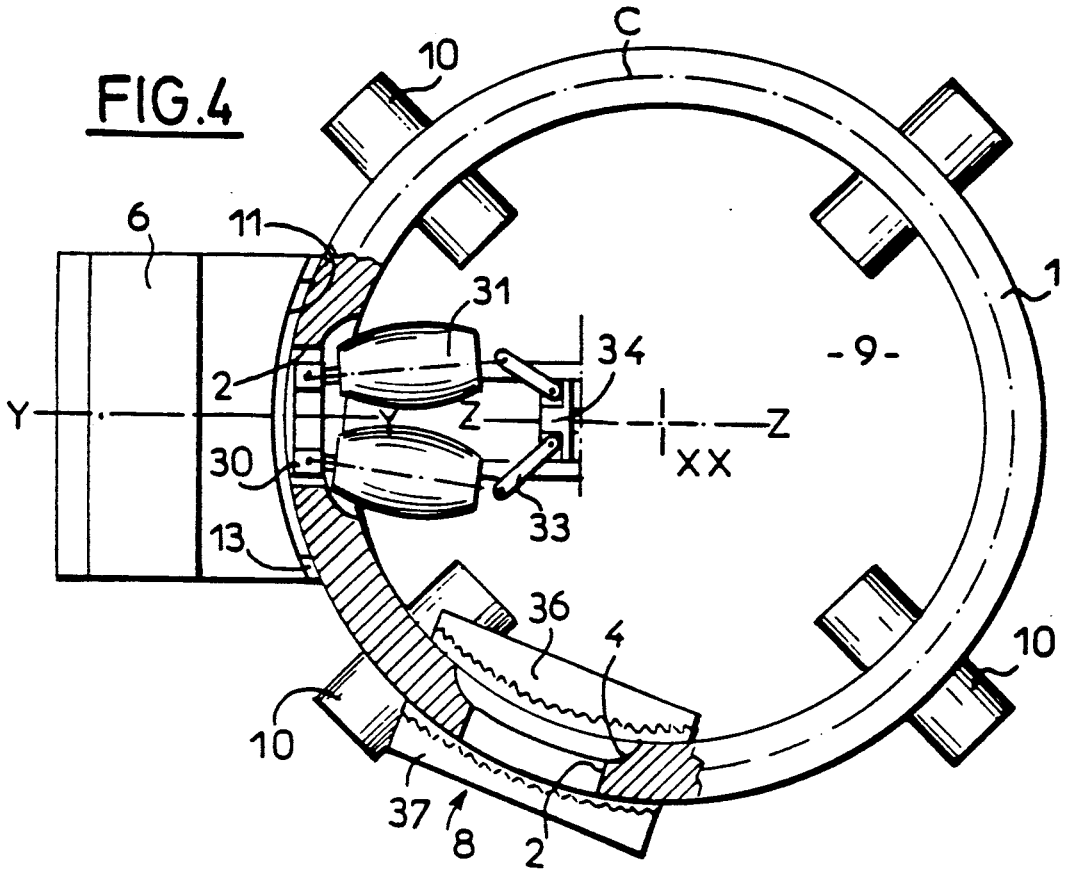
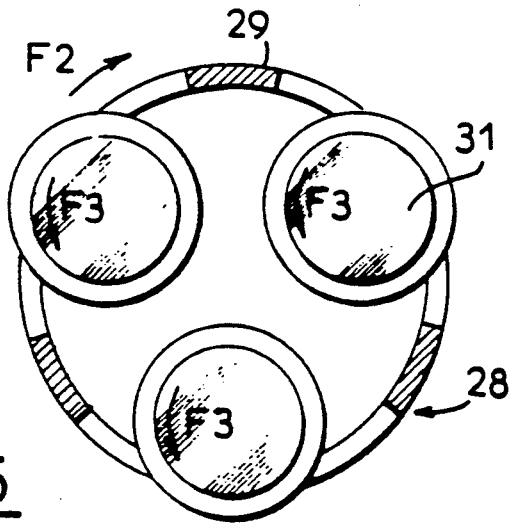
FIG.5

PROCESS AND APPARATUS FOR FORMING A CIRCULAR LIP AROUND AN OPENING

FIELD OF THE INVENTION

The present invention relates to a process for forming a circular lip around an opening of a wall, especially of a barrel, of great thickness, the thickness of the being relatively small in relation to that of the wall, of the type in which a countersink is machined around the opening, on the side opposite to the lip to be constructed, and then the metal forming the floor of the countersink is chased axially against a die on the side opposite to the countersink.

BACKGROUND OF THE INVENTION

In certain applications, it is desired to provide a wall of great thickness with at least one opening surrounded by an axially projecting lip. This is, in particular, the case for the barrels of the vessels of nuclear reactors, to which a certain number of conduits must be connected. These conduits may, in fact, be connected by welding onto the end of the lips in question, which advantageously replace the fitted standby nozzles described, for example, in FR-A-2,517,575.

However, the current techniques of forming lips of the aforementioned type, which are based on the principle of punching (see, for example, FR-A-1,198,440), are not entirely satisfactory in practice. In fact, with these processes, the connecting internal radius of the lip is the greater, the greater is the extent to which it is sought to obtain a large projection of the latter.

SUMMARY OF THE INVENTION

The object of the invention is a process for the production of lips which are relatively thin in relation to the wall of the barrel, the thickness of these lips being typically less than or equal to one-half of the thickness of the wall, while maintaining a geometry of the bore which is close to a cylinder; this permits the cross-section of metal available in the barrel for the reinforcement of the opening to be kept as large as possible.

To this end, the process in which chasing is carried out by means of at least one roller rotatably mounted on an axis and driven to execute orbital movement about the axis of the opening, the angle which the attack surface of the roller forms with this axis being progressively reduced in the course of at least a part of the advance of the roller.

According to another feature of the process, the angle reduction is obtained by reducing the angle which the axis of the roller forms with that of the opening, and/or by virtue of a convex profile of the roller.

The subject of the invention is also an apparatus for carrying out such a process, comprising:

a roller carrier equipped with means for displacement along its axis;

at least one roller rotatably mounted on an axis which is carried eccentrically by the roller carrier;

means for driving the roller according to an orbital movement about the axis of the roller carrier; and means for varying the inclination of the axis of the roller in relation to the axis of the roller carrier.

The roller may, e.g., have a cask-shape profile or, a conical profile.

Advantageously, in its application for forming a lip on a barrel, the apparatus may further comprise rolls for supporting the barrel with its axis vertical, these rolls being distributed over a circumference and oriented radially in relation to the latter. The handling of the barrel between a preheating/heating position and a machining position may then be undertaken rapidly and easily, by simple rotation of the barrel, without intervention of a travelling crane.

BRIEF DESCRIPTION OF THE DRAWINGS

An embodiment of the invention will now be described with reference to the accompanying drawings, in which:

FIG. 4 is a plan view of a part of the apparatus of FIG. 3; and

FIG. 5 is a partial view in the direction of arrow V of FIG. 3.

DETAILED DESCRIPTION

Figure 1:
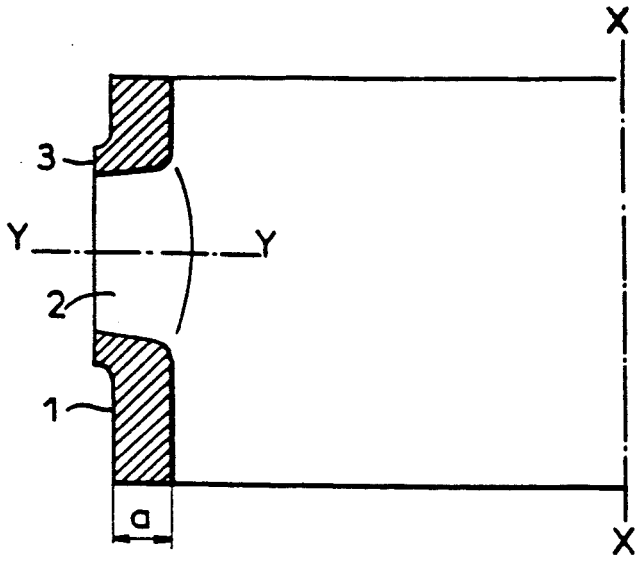
FIG. 1 is a half-view in axial cross-section of a barrel machined in accordance with the invention.

FIG. 1 represents the meridian half-section of a cylindrical barrel 1 of vertical axis X-X, comprising at least one lateral circular opening 2, of axis Y-Y perpendicular to the axis X—X. This opening is delimited by a substantially frustoconical internal surface, which is slightly convergent towards the exterior of the barrel. This barrel, of great thickness a, may, in particular, form part of the vessel of a nuclear reactor. A circular lip 3, projecting towards the exterior on the barrel, surrounds the opening 2. This lip is intended for the connection, by end to end welding, of an external duct (not shown) of the same internal diameter.

Figure 2A:
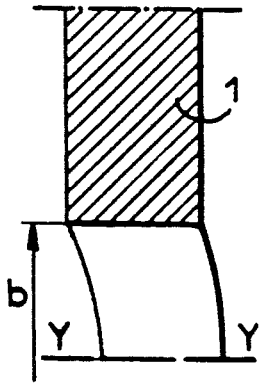
FIGS. 2A to 2C are partial detailed views illustrating the successive phases of machining leading to the barrel of FIG. 1.
Figure 2B:
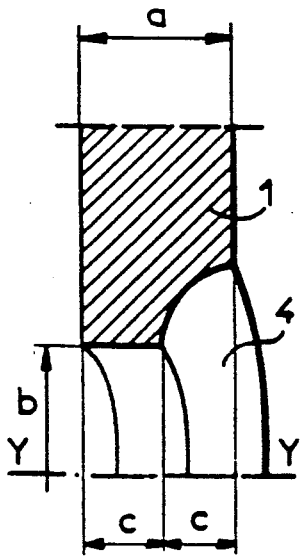
Figure 2C:
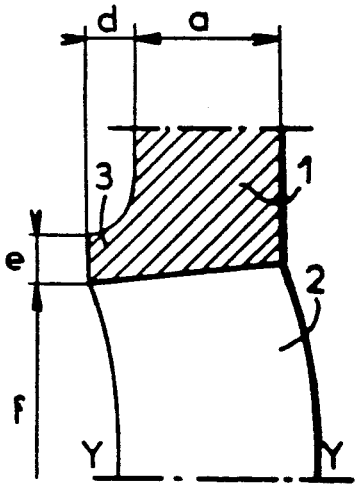

The machining of the lip 3 comprises three phases illustrated in FIGS. 2A to 2C respectively: cutting out of a circular blank of diameter b (FIG. 2A), internalside machining, on the periphery of the orifice thus obtained, of a countersink 4, the depth c of which is substantially equal to a/2 (FIG. 2B); and extrusion by chasing of the lip 3 (FIG. 2C). The lip 3 projects axially, along the axis Y—Y, by a distance d in relation to the external cylindrical wall of the barrel. At its end, it has a radial thickness e and defines an inlet opening of diameter f. For a lip on which a primary circuit conduit of a pressurized water nuclear reactor is to be welded, the following approximate values are typically applicable, $a=300$ mm, $c=150$ mm, $d=100$ to 120 mm, $e=100$ mm and $f=700$ mm, with an internal surface of the opening 2 converging according to an angle of 6° in relation to the axis Y—Y.

A more detailed description will now be given of the step of extrusion of the lip 3, with reference to FIGS. 3 to 5.

The installation used for this operation comprises a barrel support 5, a bearing block 6, a burnishing machine 7 and a heating apparatus 8.

The support 5 consists of a base 9 in which there are mounted four radially disposed rolls 10 of cylindrical shape which are regularly distributed on a circle C, the diameter of which corresponds to that of the barrel. The upper generatrix of the rolls 10 passes slightly beyond the level of the base 9.

The block 6 is fixed on the base 9 outside the circle C, between two rolls 10. It comprises a cylindrical recess 11 coaxial with the circle C (FIG. 4), receiving a sector of the barrel 1 when the latter is positioned on the rolls 10. In this recess there is formed a cylindrical cavity 12 (FIG. 3), the axis of which coincides with the axis Y-Y during the operation of cutting back described hereinbelow. The entrance of this cavity 12 is bordered by a circular bearing die 13, the profile of which corresponds to the external profile of the lip 3 to be constructed.

The burnishing machine 7 is entirely disposed within the circle C. It comprises a frame 14, itself comprising two vertical uprights 15 within a circular opening of which there is mounted, for sliding and for rotation, a cylindrical jack body 16, the axis Z—Z of which coincides with that of the cavity 12. A first electric motor 17 carried by the frame can drive in rotation, via a gear 18, a thrust screw 19 parallel to the axis X—X, guided by the frame 14. This screw acts via an end shoe 20 on a vertical plate 21, which is perpendicular to the axis Z—Z and guided in translation parallel to this axis, which plate is freely traversed by the jack body 16. In a variant, the screw-nut system may be replaced by a double-acting hydraulic or pneumatic jack. The plate 21 constitutes a support for a second electric motor 22 and is supported outwardly, i.e., towards the block 6, against a flange 23 integral with the cylinder 16, this taking place via a ball bearing 24. The motor 22 comprises an output pinion 25, which engages with a pinion 26 integral with the jack body 16. Other motor 17-gear 18-screw 19 assemblies may, of course, be provided and regularly distributed about the axis Z—Z.

The cylinder 16 forms a double-acting hydraulic or pneumatic jack body in which a piston 27 is displaced. This body is extended towards the exterior by a cylindrical roller carrier 28 consisting of three bars 29 parallel to the axis Z—Z (FIG. 5) and connected at their outer end by a ring 30 (FIGS. 3 and 4).

Three rollers 31 having a cask-shape profile are intercalated between the bars 29 (FIG. 5), projecting radially in relation to the latter. The axis 32 of each roller converges towards the exterior, is situated in a plane passing through the axis Z—Z and is articulated by its outer end to the ring 30 and by its inner end to the outer end of a respective connecting rod 33 which converges towards the interior. Each connecting rod 33 is articulated at its inner end onto a sliding plate 34 fixed to the end of the rod of the piston 27.

Figure 3:
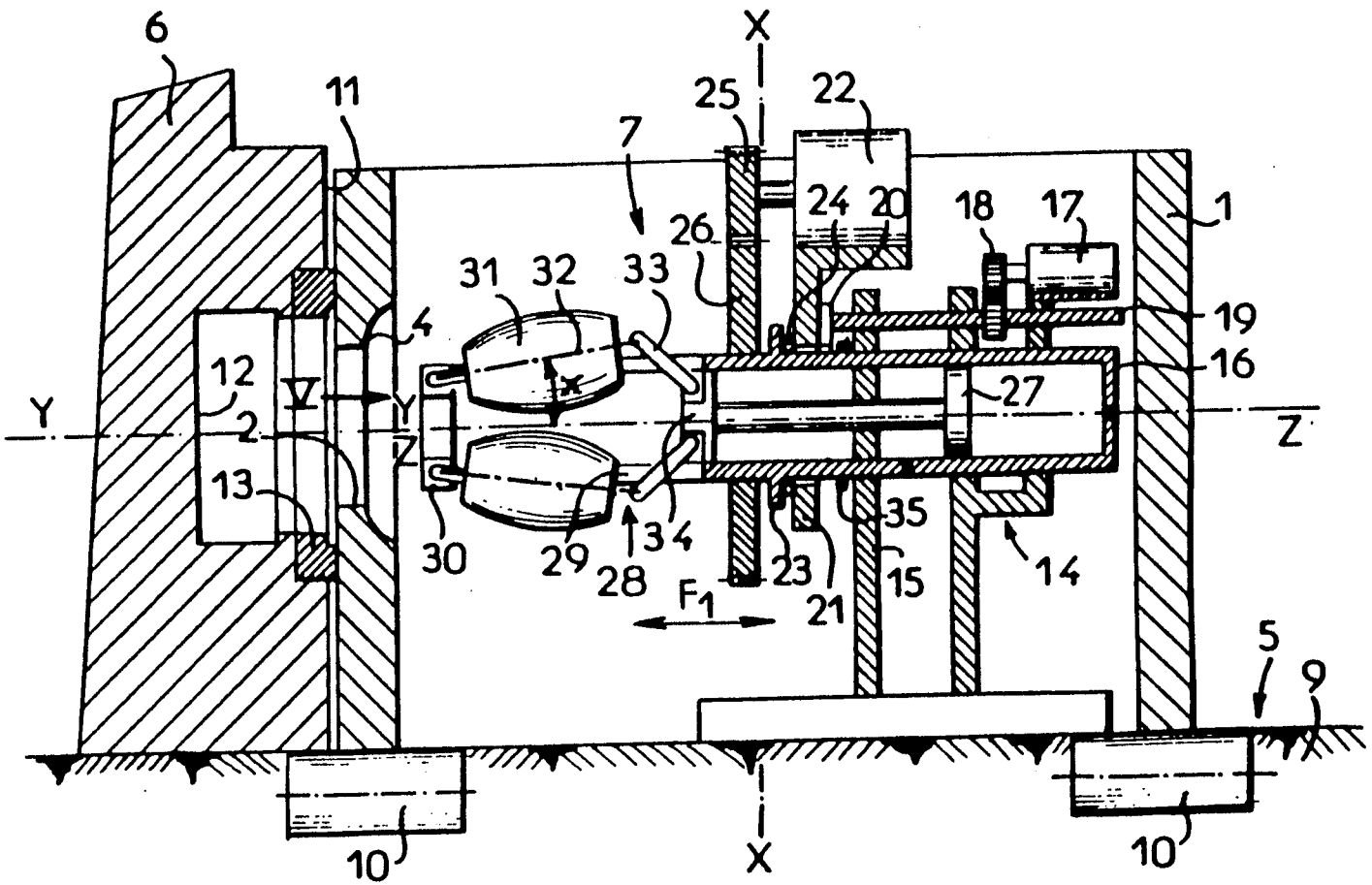
FIG. 3 schematically shows, in vertical cross-section, an apparatus according to the invention.

The machine 7 thus permits the three rollers 31 to be caused to execute the following movements:

By actuation of the motor 17, an overall translational movement along the axis Z—Z (arrow F1 of FIG. 3). The withdrawal movement towards the interior of the cylinder 16 and of the roller carrier is obtained by action of the shoe 20 on a second flange 35 provided on the jack body 16.

By activation of the motor 22, an overall rotation, i.e., an orbital movement, of the three rollers about the axis Z—Z, in the direction of arrow F2 of FIG. 5. When the rollers bear against the barrel, this movement causes a rotation of each roller about its own axis 32 (arrows F3 of FIG. 5).

By actuation of the jack 16-27, modification of the inclination x (FIG. 3) of the axes 32 of the rollers in relation to the axis Z—Z of the roller carrier.

The heating apparatus 8 (FIG. 4) is movable and comprises an internal convex part 36 and an external concave part 37. It may be electrical or may incorporate gas burners.

In operation, the cylinder 16 being withdrawal position (towards the right of FIGS. 3 and 4), the piston 27 being in the extension position i.e., the angle x being at maximum) and the heating apparatus 8 being retracted, the barrel is positioned on the four rolls 10, with its axis X—X vertical. It will be assumed that this barrel has two openings 2 (FIG. 4), which have been prepared with a countersink 4 as in FIG. 2B.

The heating apparatus 8 is brought opposite one of the two openings, preheats that opening to approximately 500° C, and then heats it to the extrusion temperature of the lip 3, within the range between 950° and 1200° C. The apparatus 8 is then removed, and the barrel is caused to turn about its axis on the rolls 10 until such time as the axis Y—Y of the opening 2 thus heated coincides with the axis Z—Z of the die 13 and of the cylinder 16.

A first forming-extrusion passage of the lip is then carried out by exerting a thrust, of the order of 100 to 1000 metric tons, along the axis Z—Z, by means of the motor 17, and by simultaneously causing the cylinder 16 and the roller carrier 28 to turn about their axis by means of the motor 22.

At the start of this thrust, as indicated hereinabove, the piston 27 is in extension in order to impart a maximum value to the angle x. Progressively as the extrusion of the lip proceeds, this angle is reduced, by progressive withdrawal of the piston, this taking place in such a manner that each roller constantly attacks the lip in formation according to an angle which is as small as possible. It should be noted that this angle of attack is a function both of the angle of inclination x and of the angle which is formed with the axis 32 by the tangent to the external surface of the roller at the point of attack, this angle itself also varying in the course of the advance of the roller carrier, in view of the caskshaped form of the rollers.

A plurality of successive passes are performed; when the temperature of the opening in the course of machining falls to a predetermined low value, the barrel is caused to pivot, the apparatus 8 is placed in position again, and a new heating is performed.

This process permits the lip 3 to be obtained while ensuring the continuity of the fibers of the metal of the barrel. In particular, the central heterogeneous zones of the thickness of the barrel do not open onto the bore; this is favorable as regards the mechanical behavior of the whole. Furthermore, the connection by welding of conduits to the barrel is undertaken on the lips 3; this is advantageous from the point of view of the stresses suffered by the barrel.

It is noted that, during the last forming passage, the heating apparatus 8 may be placed in position so as to face another opening 2 to be machined, as represented in FIG. 4; this reduces the total time required for production of the barrel.

In a variant, it is possible to replace the rollers 31 by rollers having a different shape, in particular a frustoconical shape converging towards the exterior. In this case, the angle of attack of the rollers on the lip in formation is dependent only upon the inclination x of the axes of the rollers.

I claim:

1. Process for forming a circular lip around a circular opening of a cylindrical wall of a metal barrel of great thickness, the lip having a thickness which is small relative to the thickness of the wall, the process comprising the steps of:

(a) machining a countersink around the opening, on a side of said wall opposite to the lip to be formed; and (b) axially chasing metal forming a floor of the countersink against a die on the side opposite to the countersink;

(c) said chasing being carried out by means of at least one roller rotatably mounted on an axis and driven to execute orbital movement about the axis of the opening and simultaneous axial movement along said axis;

(d) the angle which the axis of the roller forms with the axis of the opening being progressively and positively reduced in the course of at least a part of the advance of the roller.

2. Process according to claim 1, wherein said roller has a continuous convex profile.

3. Process according to claim 1, wherein a plurality of said rollers are regularly distributed about the axis of said opening and are caused to act simultaneously.

4. Apparatus for forming a circular lip around a circular opening of a cylindrical wall of a metal barrel of great thickness, the lip having a thickness which is small relative to the thickness of the wall, the apparatus comprising:

(a) a roller carrier comprising moving means for displacement along a roller carrier axis;

(b) at least one roller rotatably mounted on a roller axis which is carried eccentrically by the roller carrier;

(c) rotating means for driving the at least one roller according to an orbital movement about the axis of the roller carrier;

(d) varying means for positively varying the inclination of the axis of the at least one roller in relation to the axis of the roller carrier; and (e) means for simultaneously actuating said moving means, said rotating means and said varying means.

5. Apparatus according to claim 4, further comprising a bearing die located to face the roller carrier and having a profile corresponding to an external profile of the lip to be formed.

6. Installation according to claim 4, wherein the roller has a continuous convex profile.

7. Apparatus according to claim 4, wherein the roller has a conical profile.

8. Apparatus according to claim 4, wherein the roller is freely rotatably mounted on its axis, said rotating means driving said roller carrier in rotation about said axis of said roller carrier.

9. Apparatus according to claim 4, comprising a plurality of said rollers regularly distributed about the axis of the roller carrier, the axes of all the rollers having the same inclination to the axis of the roller carrier.

10. Apparatus according to claim 4, further comprising rolls for supporting the barrel with its axis vertical, said rolls being distributed over a circumference and oriented radially in relation to said circumference.

11. Apparatus according to claim 10, further comprising a heating apparatus and means for positioning and heating apparatus in a selected position above said circumference.

* * * * *